US006655277B2

(12) United States Patent
Dilling

(10) Patent No.: US 6,655,277 B2
(45) Date of Patent: Dec. 2, 2003

(54) ROTARY PRINTING MACHINE

(75) Inventor: Peer Dilling, Friedberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 66 days.

(21) Appl. No.: 09/938,707

(22) Filed: Aug. 24, 2001

(65) Prior Publication Data

US 2002/0078844 A1 Jun. 27, 2002

(30) Foreign Application Priority Data

Aug. 30, 2000 (DE) ..... 100 42 503

(51) Int. Cl.[7] ..... B41F 13/24

(52) U.S. Cl. ..... 101/247; 101/145; 101/185; 101/218

(58) Field of Search ..... 101/247, 216, 101/140, 143, 144, 145, 182, 184, 185, 218

(56) References Cited

U.S. PATENT DOCUMENTS 3,635,160 A * 1/1972 Specht et al. ..... 101/247
4,222,325 A * 9/1980 Edwards ..... 101/137
4,665,824 A * 5/1987 Greiner et al. ..... 101/492
4,852,515 A 8/1989 Terasaka et al. ..... 118/663
5,025,726 A 6/1991 Funabashi et al. ..... 101/352.05
5,355,796 A 10/1994 Kobler et al. ..... 101/148

FOREIGN PATENT DOCUMENTS

DE 42 11 379 10/1993
EP 051 037 5/1982

* cited by examiner

*Primary Examiner*—Andrew H. Hirshfeld
*Assistant Examiner*—Minh H. Chau
(74) *Attorney, Agent, or Firm*—Cohen, Pontani, Lieberman & Pavane

(57) ABSTRACT

In a rotary printing machine, in particular a web-fed rotary printing machine, having at least one printing unit including a plurality of printing-unit cylinders, of which at least one can be brought into and out of operative connection with at least one functional unit which is associated with a function needed to operate the printing unit, is provided with a drive device and is fitted on a linear guide device, a high level of operating convenience and working accuracy being achieved by the functional unit being assigned a positioning device, which has a controller which can be fed with at least one position-dependent signal which can be generated by means of a sensor arrangement associated with the functional unit and by which the drive device can be controlled.

19 Claims, 1 Drawing Sheet

ROTARY PRINTING MACHINE

BACKGROUND OF THE INVENTION

1. Field of the Invention

The invention relates to a rotary printing machine such as a web-fed rotary printing machine, having a printing unit comprised of a plurality of printing-unit cylinders at least one of which can be brought into and out of contact with a functional unit associated with a function needed to operate the printing unit.

2. Description of the Related Art

In the case of arrangements of the type present here, there are infeed movements between the printing-unit cylinders and the functional units associated with these. In the case of the known rotary printing machines, the infeed movements between mutually associated elements are generally implemented in each case by means of a pivoting movement limited by mechanical stops. The drawback in this case is that the stops have to be adjusted and readjusted in the event of changing conditions. The result is, therefore, a high operational outlay. Added to this is the fact that many conditions, such as the temperature of printing cylinders, change frequently or continuously, so that exact readjustment with tolerable effort is not even possible. The consequence of this is inaccurate setting, which has a detrimental effect on the achievable working result.

SUMMARY OF THE INVENTION

It is an object of the present invention to provide a rotary printing machine of the above-mentioned type while avoiding the disadvantages of the known arrangements and in which high operating convenience and accuracy are ensured.

This object is achieved by providing a rotary printing machine, in particular a webfed rotary printing machine, having at least one printing unit which comprises a plurality of printing-unit cylinders, of which at least one can be brought into and out of operative connection with at least one functional unit which is associated with a function needed to operate the printing unit, the functional unit being provided with a drive device, and fitted on a linear guide device. The functional unit is assigned a positioning device, which has a controller which can be fed with at least one position-dependent signal that can be generated by means of a sensor arrangement associated with the functional unit and by which the drive device can be controlled.

These measures make it possible to dispense with mechanical stops, so that the disadvantages associated with these are also advantageously dispensed with. The positioning device according to the invention advantageously permits exact positioning of the associated functional unit in any desired position, it being possible for automatic adaptation to changing conditions to take place. This advantageously also applies to changing cylinder diameters, which makes it easier to change format.

Other advantageous refinements and expedient developments of the higher-order measures can be made. For example, the functional unit can expediently be associated with sensor arrangements for determining the respective distance covered and the encounter with the associated printing-unit cylinder, it being possible for the output signals from the sensor arrangements to be fed to the controller. The combination of distance-based and point-based control results in particularly high accuracy when moving to a desired operating position.

The controller can advantageously be programmed in such a way that the functional unit can be moved into a desired operating position when the drive device is activated, starting from the position determined when it encounters the associated printing-unit cylinder. The position in which the functional unit encounters the associated printing-unit cylinder forms a zero point or reference point which the functional unit looks for in every case, so that an exact operating position can always be reached, irrespective of the position of this reference point. Moving the functional unit to a desired position also can involve a setting to a desired contact pressure or a desired gap width with respect to an associated printing-unit cylinder.

The sensor arrangement for determining the distance covered may expediently be associated with an incremental arrangement. In this case, digital values, which can easily be processed as data, automatically result.

A further advantageous refinement of the higher-order measures can consist in the sensor arrangement for determining the encounter between the functional unit and the associated printing-unit cylinder being designed as a strain detector associated with a part of the drive device which can be acted on by the contact pressure between functional unit and printing-unit cylinder. This detector advantageously supplies a signal which is an analog of the contact pressure. The result is therefore simultaneously a pressure sensor. This makes it easier to drive the drive device in order to reach an operating position, in which the functional unit is thrown with pressure onto the associated printing-unit cylinder. Setting the functional unit to a gap with respect to the associated printing-unit cylinder is, by contrast, expediently carried out as a function of distance.

In a further development of the higher-order measures, the controller, which is expediently designed as a programmable computer, can have a communications connection for a remote programming and/or monitoring device. This advantageously permits the rectification of maladjustments, etc., by using modern communication means, which results in extreme ease of maintenance and servicing.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
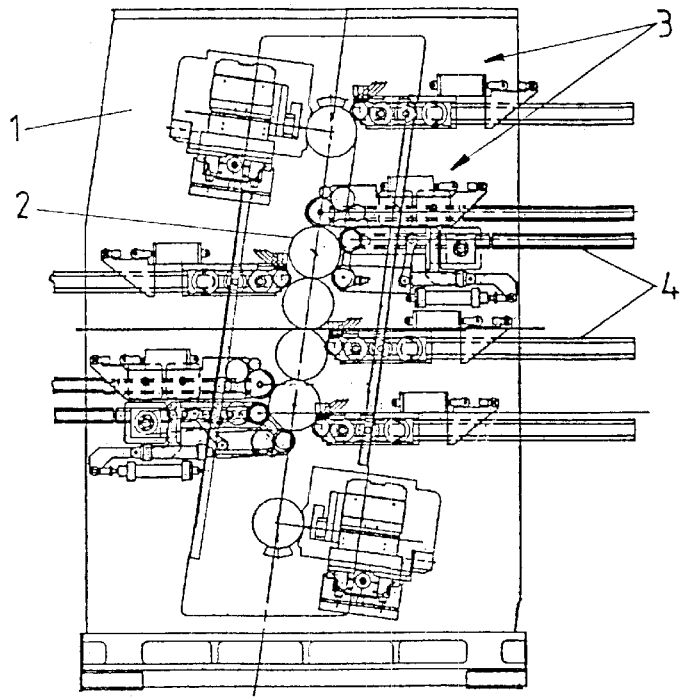
FIG. 1 shows a schematic view of a printing unit of a web-fed rotary printing machine according to the invention.

The fundamental construction and mode of action of rotary printing machines, such as web-fed rotary printing machines, are known per se and therefore do not require any more detailed explanation in the present connection. The printing unit on which FIG. 1 is based comprises a machine frame 1, on which there are mounted a plurality of printing-unit cylinders 2 which interact in a manner known per se and here form a double printing unit. Associated with the cylinders are various devices needed to operate the printing machine, such as inking units, damping units, washing devices, image-setting devices, fixing devices, erasing devices. These devices in each case form a functional unit 3 which can be inserted into the printing unit, can be preassembled completely outside the machine and is intrinsically adjustable.

At least part of the functional units 3 is in each case fitted with the frame-side ends on guide rails 4 fitted to the side walls of the machine frame 1, the rails forming a linear guide device. These functional units 3 are therefore adjustable in the linear direction with respect to the respectively associated printing-unit cylinder 2.

Figure 2:
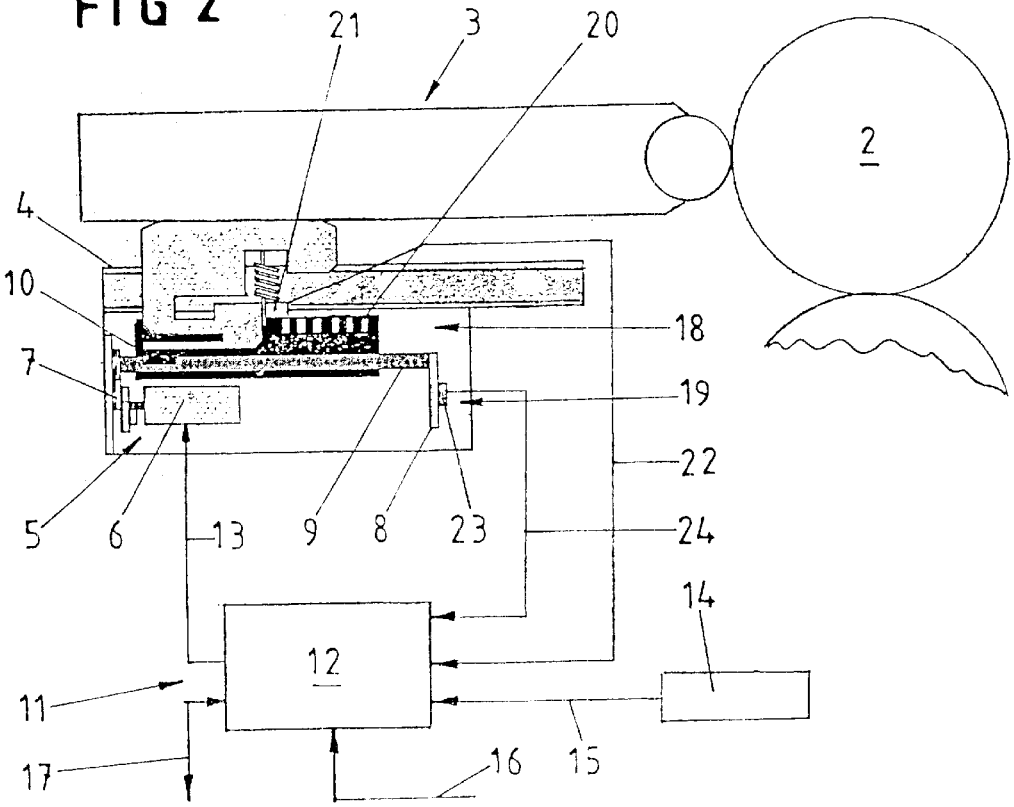
FIG. 2 shows a functional unit of the arrangement according to FIG. 1 with associated drive, guide and positioning devices.

Each of these linearly adjustable functional units is provided with a drive device 5 illustrated in more detail in FIG. 2. The drive device comprises an electric drive motor 6 which is fixed to the machine frame 1 and, via a lay shaft 7, drives a threaded spindle 9 which is mounted on bearing plates 8 fitted to the machine frame 1 and which can be brought into engagement with a threaded nut 10 fitted to the associated functional unit 3. The spindle 9 and the nut 10 are synchronous elements in that the engagement therebetween causes the nut 10 to move synchronously with the spindle 9. The nut can be a half-open threaded nut, so that simple disengagement of functional unit 3 and frame-side drive device 5 is possible, which makes the insertion or removal of the functional unit 3 particularly simple.

The drive motor 6, which may be a DC motor, can be controlled by means of a positioning device 11 which is associated with the functional unit 3 and is likewise shown in FIG. 2. The positioning device comprises a controller 12 which is designed as a programmable computer, into which the desired positions to which the functional unit 3 is intended to be able to move are input in the form of electronic data, and to which measured values corresponding to the respective current position of the functional unit 3 are fed in the form of suitable signals. As a rule, there are three positions to which the functional unit 3 must move, namely an operating position, a thrown-off position and a changeover position.

The controller 12 uses the position-dependent signals fed to it to determine control commands for the drive motor 6, which are transmitted via a signal line 13. In order to input the values of the positions to which to move, an input device 14 is provided, which is connected to the controller 12 via a signal line 15. The controller 12 also has an input for a connection, indicated by a signal line 16, to the machine control device, which provides the action commands. In addition, the controller 12 in the example shown has a remote connection, as it is called, which is associated with a signal line 17 via which communication with the controller 12 and, therefore, enabling remote programming and/or remote monitoring, etc. is possible.

The measuring elements for determining the aforementioned position-dependent measured values comprise a distance measuring device 18, which measures the distance covered in each case by the functional unit 3, and a sensing device 19 for sensing the aforementioned zero point, to which the distance measuring device 18 can make reference. The distance measuring device 18 contains an incremental element 20, with which a sensor 21 is associated, which is arranged in such a way that the result is relative movement between the incremental element 20 and sensor 21. The output from the sensor 21 is connected, via a signal line 22, to an associated input of the controller 12. The sensing device 19 contains a sensor 23 which, when the functional unit 3 encounters the associated printing-unit cylinder 2, generates a signal which is fed, via a signal line 24, to an associated input of the controller 12.

It is expedient for the zero point, which the positioning device according to the invention senses automatically in order to provide self-adjustment, as already indicated above, to be defined as the position in which the functional unit 3 runs with its working element associated with the printing-unit cylinder 2 onto the associated printing-unit cylinder 2 and touches the latter. The sensor 23 is therefore designed in such a way that a signal is output when the associated functional unit 3 runs onto the associated printing-unit cylinder 2. In the exemplary embodiment shown, the sensor 23 is designed as a strain gauge, which is fitted to a bearing plate 8 associated with the threaded spindle 9. The force flow for deriving a reaction force on the machine frame 1 that is exerted by the printing-unit cylinder 2 when the functional unit 3 runs onto the associated printing-unit cylinder 2 flows via the bearing plate 8. In this case, the bearing plate 8 is stressed in flexure, which increases with increasing contact force and vice-versa.

The strain gauge forming the sensor 23 therefore supplies a signal which is an analog of the contact pressure. The start of this signal virtually corresponds to the first contact and therefore to the aforementioned zero point. The further course of this signal correlates with the contact pressure. The signal supplied by the sensor 23 therefore advantageously contains two items of information, namely an indication of the contact point, which can be used as the zero point, and an indication of the contact pressure, whose accurate maintenance is desired in many cases.

The controller 12 is programmed here in such a way that the functional unit 3 can be moved into a desired operating position when the drive device 5 is activated, starting from the zero point automatically found in the manner presented above. Since the positioning device 11 always determines the aforementioned zero point itself as the contact point, the result is automatic self-adjustment, changing conditions, for example as a result of temperature fluctuations, etc., automatically being controlled out. The same also applies to different diameters of the printing-unit cylinders 2, so that no adjustment operations arise, even with a change of format.

Some functional units 3 are thrown onto the associated printing-unit cylinder 2 with pressure when operating, others are set to a gap from the associated printing-unit cylinder 2. First of all, in each case the zero position is moved to, which corresponds to the contact position at which the operating element of the functional unit 3 encounters the associated printing-unit cylinder 2. If a gap is to be set, the drive motor 6 is driven by the controller 12 in such a way that the functional unit 3 covers a distance corresponding to the clear gap width, starting from the aforementioned zero position. The distance covered is determined exactly by means of the distance measuring device 18, so that the functional unit 3 comes exactly into the desired position at which the desired gap width is present. In order to maintain this gap width over relatively long time periods, provision can be made to move to the zero position again from time to time and to reset the gap width.

When larger editions are being printed, this can be carried out, for example, during the operating interruptions necessitated by the operation, for example during the stoppages for washing. In the case of smaller editions, one generally manages with one setting per print job.

The action of transporting the functional unit 3 into the thrown-off waiting position or the changeover position, in which the functional unit 3 can be removed or inserted, also proceeds in a similar way to the setting of a gap.

If the functional unit 3 is intended to cooperate with the associated printing-unit cylinder 2 while maintaining a predefined contact pressure, the drive motor 6 is driven by the controller 12 in such a way that the functional unit 3, starting from the aforementioned zero position, is fed in until the desired contact pressure is signalled by the sensor 23. The signal output by the sensor 23 is a continuous signal, whose level is continuously compared with a predefined desired value by the controller 13. Each time there is a change in the current value, the result is therefore automatic readjustment, so that the desired contact pressure is maintained permanently.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A rotary printing machine, comprising:

a printing unit including a plurality of printing-unit cylinders;

a functional unit associated with a function needed to operate the printing unit, a linear guide device on which said functional unit is fitted for movement in a linear direction with respect to one printing-unit cylinder of said plurality of printing-unit cylinders;

a drive device for moving said functional unit on said linear guide device such that said functional unit and said one printing-unit cylinder are relatively movable into and out of connection with one another;

a sensor arrangement associated with each said functional unit for generating a position-dependent signal; and a positioning device associated with said functional unit and including a controller, said controller controlling said drive device responsive to said position-dependent signal, wherein said sensor arrangement includes a sensor operative for sensing a functional unit travel distance when said drive device is activated and outputting a sensed travel distance signal to said controller, and another sensor for sensing a travel encounter of said functional unit with said one printing-unit cylinder and outputting an encounter signal to said controller.

2. A rotary printing machine according to claim 1, wherein said other sensor is operative to output a signal to said controller which is indicative of a contact pressure between said functional unit and said one printing-unit cylinder.

3. A rotary printing machine according to claim 2, wherein said other sensor output signal is a continuous analog signal of contact pressure, a start of said analog signal corresponding to encountering of said functional unit with said one printing-unit cylinder.

4. A rotary printing machine according to claim 2, wherein said other sensor is a strain gauge, said strain gauge being associated with a drive device part to which said contact pressure is transmitted.

5. A rotary printing machine according to claim 4, wherein said drive device includes a drive motor, an advance spindle driven by said motor, and a bearing plate associated with said spindle, said strain gauge being associated with said bearing plate.

6. A rotary printing machine according to claim 1, wherein said controller is programmed so that upon a travel encounter of said functional unit with said one printing-unit cylinder, said drive device moves said functional unit from a position thereof at encounter with said one printing-unit cylinder to a desired operating position.

7. A rotary printing machine according to claim 6, wherein said desired operating position is one where a gap exists between said functional unit and said one printing-unit cylinder, said drive device being operated to move said functional unit to said desired position as a function of functional unit travel distance.

8. A rotary printing machine according to claim 6, wherein said desired operating position is one where said functional unit and said one printing-unit cylinder are in pressure contact with each other, said drive device being operated to move said functional unit to said desired position as a function of contact pressure.

9. A rotary printing machine according to claim 1, wherein said functional unit is selectively positionable at any one of an operating position, a thrown-off position and a change position along a functional unit displacement path.

10. A rotary printing machine according to claim 1, wherein said functional unit is fitted at each of opposite sides thereof on guide device elements, said drive device including synchronously operated elements, said functional unit being engaged with one of said synchronously operated elements.

11. A rotary printing machine according to claim 1, wherein said sensor for sensing functional unit travel distance is associated with an incremental element.

12. A rotary printing machine according to claim 1, wherein said controller is a programmable computer connected with a machine control system, and an input device connected to said computer.

13. A rotary printing machine according to claim 12, wherein said computer includes a communications connection for enabling at least one of a remote programming and a remote monitoring of said computer.

14. A rotary printing machine, comprising:

a printing unit including a plurality of printing-unit cylinders;

at least one functional unit associated with a function needed to operate the printing unit;

a linear guide device on which said at least one functional unit is fitted for movement in a linear direction with respect to at least one of said printing-unit cylinders;

a drive device for moving said functional unit on said linear guide device such that said at least one functional unit and said at least one of said printing-unit cylinders are relatively movable into and out of connection with one another;

a sensor arrangement associated with each said functional unit for generating a position-dependent signal; and a positioning device associated with said at least one functional unit and including a controller, said controller controlling said drive device responsive to said position-dependent signal, wherein said sensor arrangement includes a sensor for sensing a travel encounter of said functional unit with said one printing-unit cylinder, said sensor being operative to output a signal to said controller which is indicative of a contact pressure between said functional unit and said one printing-unit cylinder.

15. A rotary printing machine according to claim 14, wherein said sensor output signal is a continuous analog signal of contact pressure, a start of said analog signal corresponding to encountering of said functional unit with said one printing-unit cylinder.

16. A rotary printing machine according to claim 14, wherein said controller is programmed so that upon a travel encounter of said functional unit with said one printing-unit cylinder, said drive device moves said functional unit from a position thereof at encounter with said one printing-unit cylinder to a desired operating position.

17. A rotary printing machine according to claim 16, wherein said desired operating position is one where said functional unit and said one printing-unit cylinder are in pressure contact with each other, said drive device being operated to move said functional unit to said desired position as a function of contact pressure.

18. A rotary printing machine according to claim 14, wherein said sensor is a strain gauge, said strain gauge being associated with a drive device part to which said contact pressure is transmitted.

19. A rotary printing machine according to claim 18, wherein said drive device includes a drive motor, an advance spindle driven by said motor, and a bearing plate associated with said spindle, said strain gauge being associated with said bearing plate.

* * * * *